US008371139B2

(12) United States Patent
Kim et al.

(10) Patent No.: US 8,371,139 B2
(45) Date of Patent: Feb. 12, 2013

(54) ICE MAKING APPARATUS AND REFRIGERATOR HAVING THE SAME

(75) Inventors: Ji Hoon Kim, Gwangsan-gu (KR); Jin Ho Kim, Damyang-gun (KR)

(73) Assignee: Samsung Electronics Co., Ltd., Suwon (KR)

( * ) Notice: Subject to any disclaimer, the term of this patent is extended or adjusted under 35 U.S.C. 154(b) by 415 days.

(21) Appl. No.: 12/659,402

(22) Filed: Mar. 8, 2010

(65) Prior Publication Data

US 2011/0011116 A1 Jan. 20, 2011

(30) Foreign Application Priority Data

Jul. 20, 2009 (KR) ..... 10-2009-0065751

(51) Int. Cl.
*F25C 1/00* (2006.01)

(52) U.S. Cl. ..... 62/347; 62/349

(58) Field of Classification Search ..... 62/347, 62/449, 340, 344
See application file for complete search history.

(56) References Cited

U.S. PATENT DOCUMENTS

| | | | | |
|---|---|---|---|---|
| 5,904,054 | A | 5/1999 | Lee | |
| 5,971,213 | A * | 10/1999 | Lee | 222/146.6 |
| 7,318,323 | B2 * | 1/2008 | Tatsui et al. | 62/320 |
| RE43,409 | E * | 5/2012 | Kwon | 62/398 |
| 2006/0112715 | A1 * | 6/2006 | Chung | 62/340 |
| 2006/0168983 | A1 * | 8/2006 | Tatsui et al. | 62/340 |
| 2006/0226170 | A1 * | 10/2006 | Larsen | 222/64 |
| 2007/0295023 | A1 * | 12/2007 | Yoon et al. | 62/338 |
| 2008/0041089 | A1 * | 2/2008 | Choi et al. | 62/344 |
| 2008/0202147 | A1 * | 8/2008 | Lim et al. | 62/389 |
| 2008/0289355 | A1 * | 11/2008 | Kang et al. | 62/344 |
| 2009/0178431 | A1 | 7/2009 | Cho | |

FOREIGN PATENT DOCUMENTS

| | | |
|---|---|---|
| JP | 8-303916 | 11/1996 |
| KR | 10-2008-0078447 | 8/2008 |
| WO | 2008/030020 | 3/2008 |

OTHER PUBLICATIONS

German Office Action, dated Jun. 30, 2011 issued in German Patent Application No. 10 2010 002 888.6.

* cited by examiner

*Primary Examiner* — Mohammad Ali
(74) *Attorney, Agent, or Firm* — Staas & Halsey LLP

(57) ABSTRACT

An ice making apparatus, in which a valve cap is opened by manually adjusting a valve member of a water storage unit when making ice cubes, and a refrigerator having the same. The ice making apparatus includes a water storage unit having a storage main body, in which water is stored, an ice making unit to make ice cubes through supply of water stored in the storage main body, at least one valve member to open and close a water supply hole, through which water stored in the storage main body is supplied to the ice making unit, and an opening and closing member to move the at least one valve member so as to open the water supply hole.

23 Claims, 10 Drawing Sheets

ICE MAKING APPARATUS AND REFRIGERATOR HAVING THE SAME

CROSS-REFERENCE TO RELATED APPLICATIONS

This application claims the benefit of Korean Patent Application No. 2009-0065751, filed on Jul. 20, 2009 in the Korean Intellectual Property Office, the disclosure of which is incorporated herein by reference.

BACKGROUND

1. Field

Embodiments relate to an ice making apparatus, which has an improved structure of a water storage unit storing water to make ice, and a refrigerator having the same.

2. Description of the Related Art

In general, a refrigerator is an apparatus that stores foods at a low temperature for a long time. The refrigerator includes a freezing chamber to store foods at a relatively low temperature, and a refrigerating chamber to store foods at a relatively high temperature.

In general, a refrigerator is an apparatus that stores foods at a low temperature for a long time. The refrigerator includes a freezing chamber to store foods at a relatively low temperature, and a refrigerating chamber to store foods at a relatively high temperature.

Recently, refrigerators having various additional functions according to customer requirements have been developed and manufactured. A representative one of these refrigerators is a refrigerator having a hand-operated ice making apparatus, which stores water supplied from the outside, makes ice cubes, and stores and supplies the ice cubes.

Such a hand-operated ice making apparatus generally includes a water storage unit to store water, an ice making unit having an ice making tray to make ice cubes using water supplied from the water storage unit, an ice storage container to store the ice cubes made by the ice making unit, and an ice transfer unit to transfer the ice cubes stored in the ice storage container to a user.

However, in the above conventional ice making apparatus, since water stored in the water storage unit is automatically supplied to the ice making tray simultaneously with mounting of the ice storage unit, if the ice cubes in the ice making tray are not separated from the ice making tray yet, water overflows the ice making tray.

Further, if the water storage unit containing water is assembled when the ice making tray is not assembled, a valve cap is automatically opened and thus water spills onto the floor.

Further, in order to automatically supply water to the ice making tray, the valve cap needs to be opened under the condition that the water storage unit is assembled. If water is supplied to the ice making tray and a small amount of water remains on the valve cap, water is frozen in the opened state of the valve cap, and thus if water is additionally supplied to the water storage unit, water leaks from the valve cap.

SUMMARY

Therefore, it is one aspect to provide an ice making apparatus, in which a vale cap is opened by manually adjusting a valve member of a water storage unit when making ice cubes, and a refrigerator having the same.

It is another aspect to provide an ice making apparatus, in which an opening and shutting lever is configured such that it is manipulated to supply water after a water storage unit is mounted and then is automatically closed when a designated time elapses, and thus convenience in use is improved, and a refrigerator having the same.

Additional aspects will be set forth in part in the description which follows and, in part, will be apparent from the description, or may be learned by practice of the embodiments.

In accordance with one aspect, an ice making apparatus includes a water storage unit having a storage main body, in which water is stored, an ice making unit to make ice cubes through supply of water stored in the storage main body, at least one valve member to open and close a water supply hole, through which water stored in the storage main body is supplied to the ice making unit, and an opening and closing member to move the at least one valve member so as to open the water supply hole.

The opening and closing member may include a pushing member having an opening and closing lever, which move the at least one valve member when pressure is applied to the opening and closing lever.

The opening and closing member may include a rotating member having an opening and closing lever, which move the at least one valve member when the opening and closing lever is rotated.

The at least one valve member may include an interlocking part having a rod shape moving in connection with movement of the opening and closing lever, and a valve cap moving along the interlocking part to open and close the water supply hole.

The opening and closing member may further include an elastic restoring unit having a spring part to apply restoring force to the opening and closing lever.

A gear part having a gear shape may be integrally formed with the opening and closing lever, and the opening and closing member may further include an oil damper connected to the gear part.

The opening and closing member may further include a contact pressure part contacting the interlocking part, and the interlocking part may move along the contact pressure part when the opening and closing lever moves.

The interlocking part may be formed in an approximately L-shaped rod shape, and one end of the interlocking part may contact the opening and closing lever and the other end of the interlocking part may be fixed to a rear surface of a bottom of the water storage unit.

The interlocking part may include a contact protrusion moving along a guide plane of the contact pressure part, and a connection rod extended from the contact protrusion, and the connection rod may be fixed to a rear surface of a bottom of the water storage unit through a fixing member.

The at least one valve member may further include a connection part to connect the interlocking part to the valve cap, and a spring part to apply elastic restoring force to the interlocking part and the valve cap.

The water supply hole may include a first water supply hole and a second water supply hole, the at least one valve member may include a first valve member to open and close the first water supply hole and a second valve member to open and close the second water supply hole, and the opening and closing member may move the first and second valve members.

The opening and closing lever may include a guide groove.

The water storage unit may include a grip.

The opening and closing lever may be made of plastic.

The ice making unit may include ice making trays, and anti-overflow members to prevent overflow of water supplied to the ice making trays.

The at least one valve member may be installed lengthily in a first direction, the opening and closing member may move in a third direction in order to move the at least one valve member in a second direction, and at least one of the first, second, and third directions may be perpendicular to another of the first, second, and third directions.

An ice storage container, and an ice transfer unit to transfer ice cubes stored in the ice storage container to an ice discharge hole formed through the ice storage container may be provided below the ice making unit.

In accordance with a further aspect, an ice making apparatus includes a water storage unit having a storage main body, in which water is stored, an ice making unit to make ice cubes through supply of water stored in the storage main body, at least one valve member to open and close a water supply hole, through which water stored in the storage main body is supplied to the ice making unit, an opening and closing member to move the at least one valve member so as to open the water supply hole through user manipulation, an elastic restoring unit being capable of restoring the opening and closing member, and a restoring delay unit to reduce a restoring speed of the opening and closing member by the elastic restoring unit.

In accordance with another aspect, a refrigerator includes a main body provided with storage chambers, doors to respectively open and close the storage chambers, and an ice making apparatus provided on a rear surface of any one of the doors to make ice cubes, wherein the ice making apparatus includes an ice making housing provided on the rear surface of the any one of the doors, and a water storage unit detachably installed on the ice making housing, and the water storage unit includes a storage main body having first and second water supply holes, first and second valve members having a rod shape to respectively open and close the first and second water supply holes, and an opening and closing member having an opening and closing lever contacting the first and second valve members to ascend and descend the first and second valve members.

Each of the first and second valve members may include an L-shaped interlocking part moving in connection with movement of the opening and closing lever, and a valve cap to open and close each of the first and second water supply holes along the interlocking part.

The first and second valve members may be disposed perpendicularly to one direction such that they ascend and descend in the direction, and the opening and closing member may include a pushing member having an opening and closing lever contacting the first and second valve members and applying pressure to the first and second valve members through a pushing operation.

The first and second valve members may be disposed perpendicularly to one direction such that they ascend and descend in the direction, and the opening and closing member may include a rotating member having an opening and closing lever contacting the first and second valve members and applying pressure to the first and second valve members through a rotating operation.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
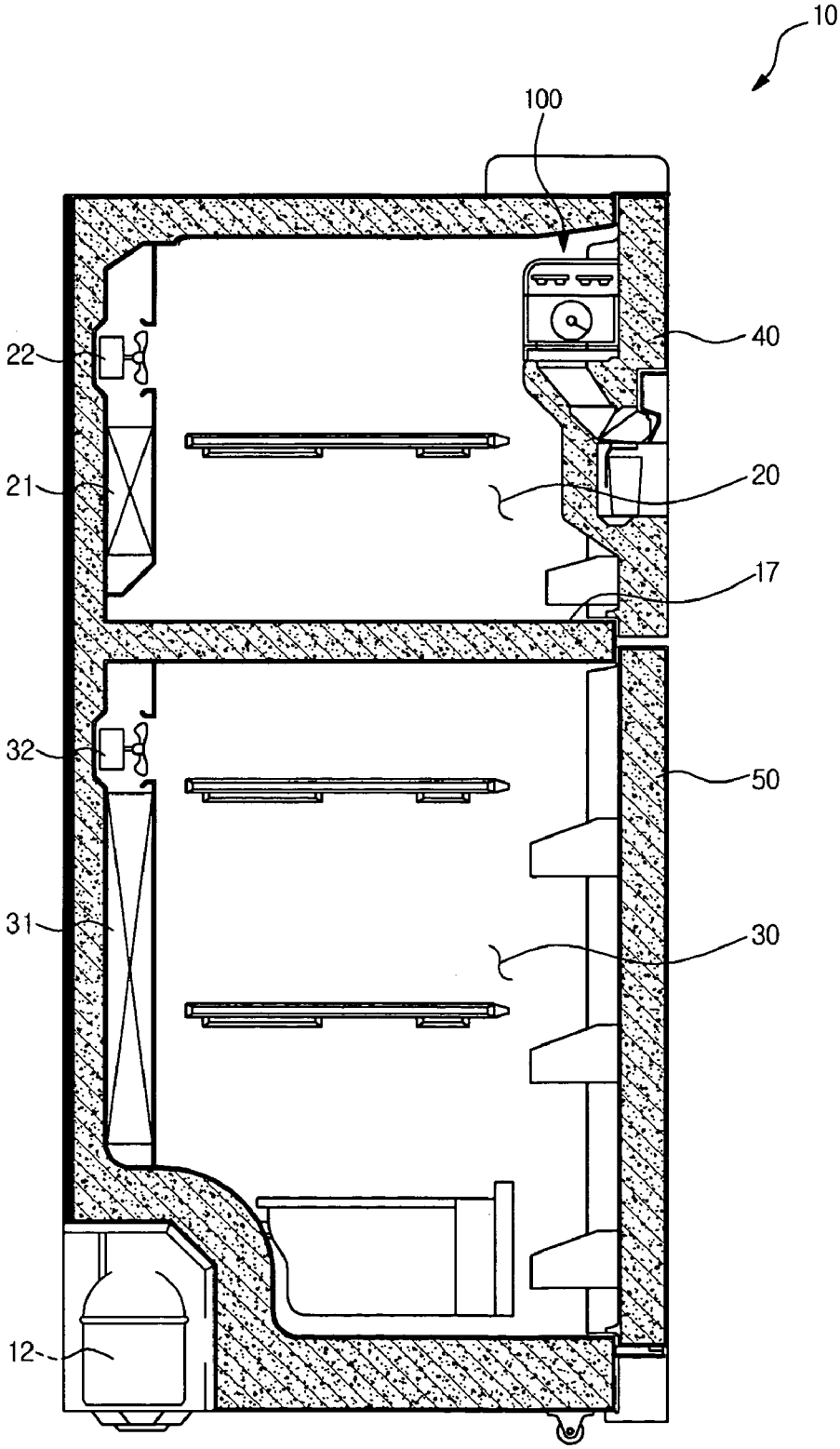
FIG. 1 is a longitudinal-sectional view of a refrigerator in accordance with an embodiment.

Reference will now be made in detail to the embodiments, examples of which are illustrated in the accompanying drawings, wherein like reference numerals refer to like elements throughout.

FIG. 1 is a longitudinal-sectional view of a refrigerator.

As shown in FIG. 1, the refrigerator includes a main body 10 having a freezing chamber 20 and a refrigerating chamber 30, which are divided from each other by a diaphragm 17.

Front surfaces of the freezing chamber 20 and the refrigerating chamber 30 are opened, and the upper freezing chamber 20 is opened and closed by a freezing chamber door 40, and the lower refrigerating chamber 30 is opened and closed by a refrigerating chamber door 50.

A freezing chamber evaporator 21 to cool the freezing chamber 20 and a freezing chamber circulation fan 22 to circulate cool air of the freezing chamber 20 are installed at the rear portion of the inside of the freezing chamber 20. Further, a refrigerating chamber evaporator 31 to cool the refrigerating chamber 30 and a refrigerating chamber circulation fan 32 to circulate cool air of the refrigerating chamber 30 are installed at the rear portion of the inside of the refrigerating chamber 30. Non-described reference numeral 12 is a compressor to compress a refrigerant supplied to the freezing chamber evaporator 21 and the refrigerating chamber evaporator 31.

The freezing chamber door 40 and the refrigerating chamber door 50 are rotatably connected to the main body 10 so as to be rotated right and left and thus open and close the freezing chamber 20 and the refrigerating chamber 30. In the embodiment, the disposition and structure of the doors 40 and 50 respectively opening and closing the respective storage chambers, i.e., the freezing chamber 20 and the refrigerating chamber 30, are exemplary, and thus may be modified into various types.

In the freezing chamber door of the refrigerator in accordance with the embodiment, an ice making apparatus 100 is provided. Hereinafter, an ice making apparatus 100 in accordance with one embodiment will be described.

Figure 2:
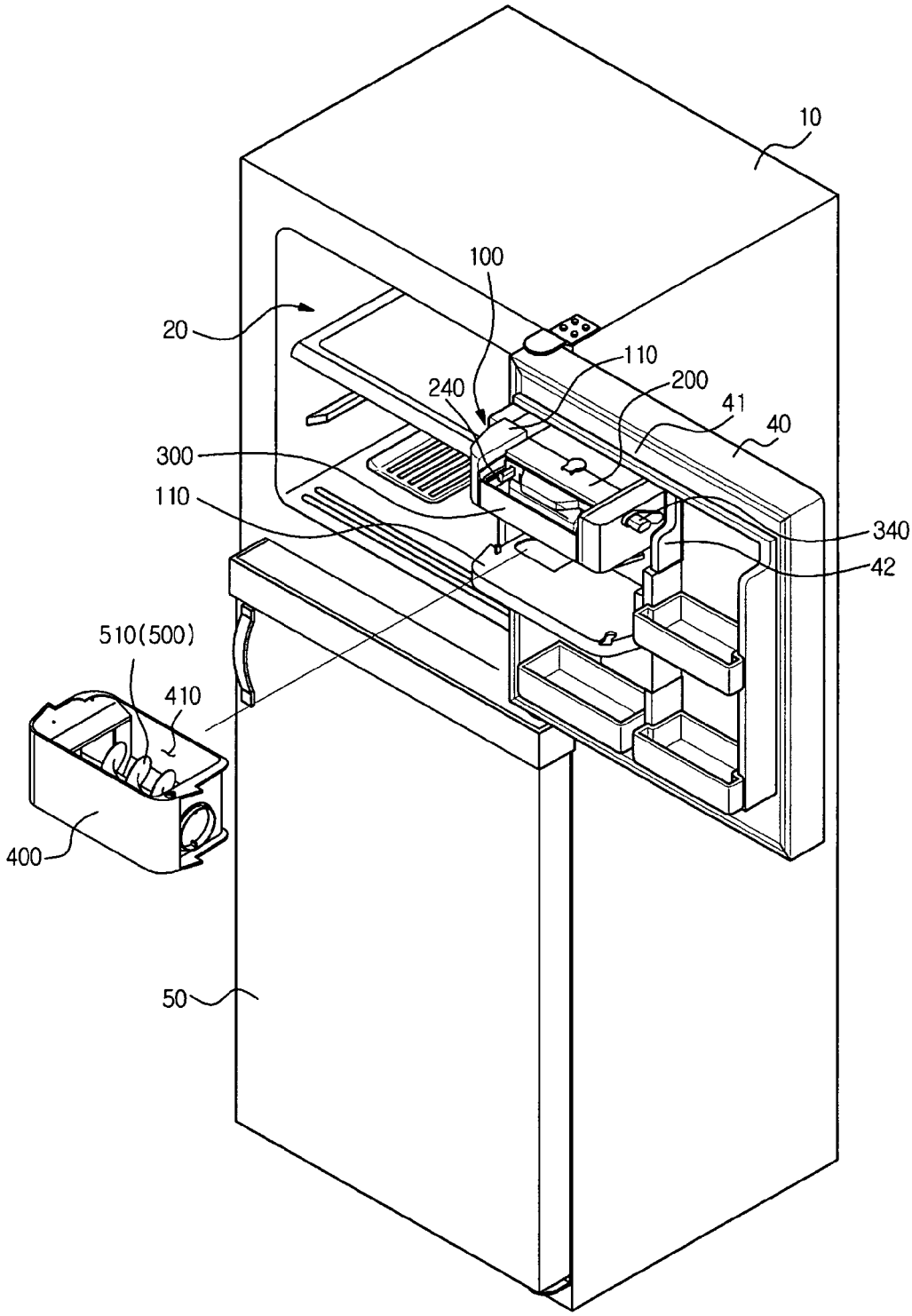
FIG. 2 is a perspective view of a refrigerator in accordance with the embodiment.
Figure 3:
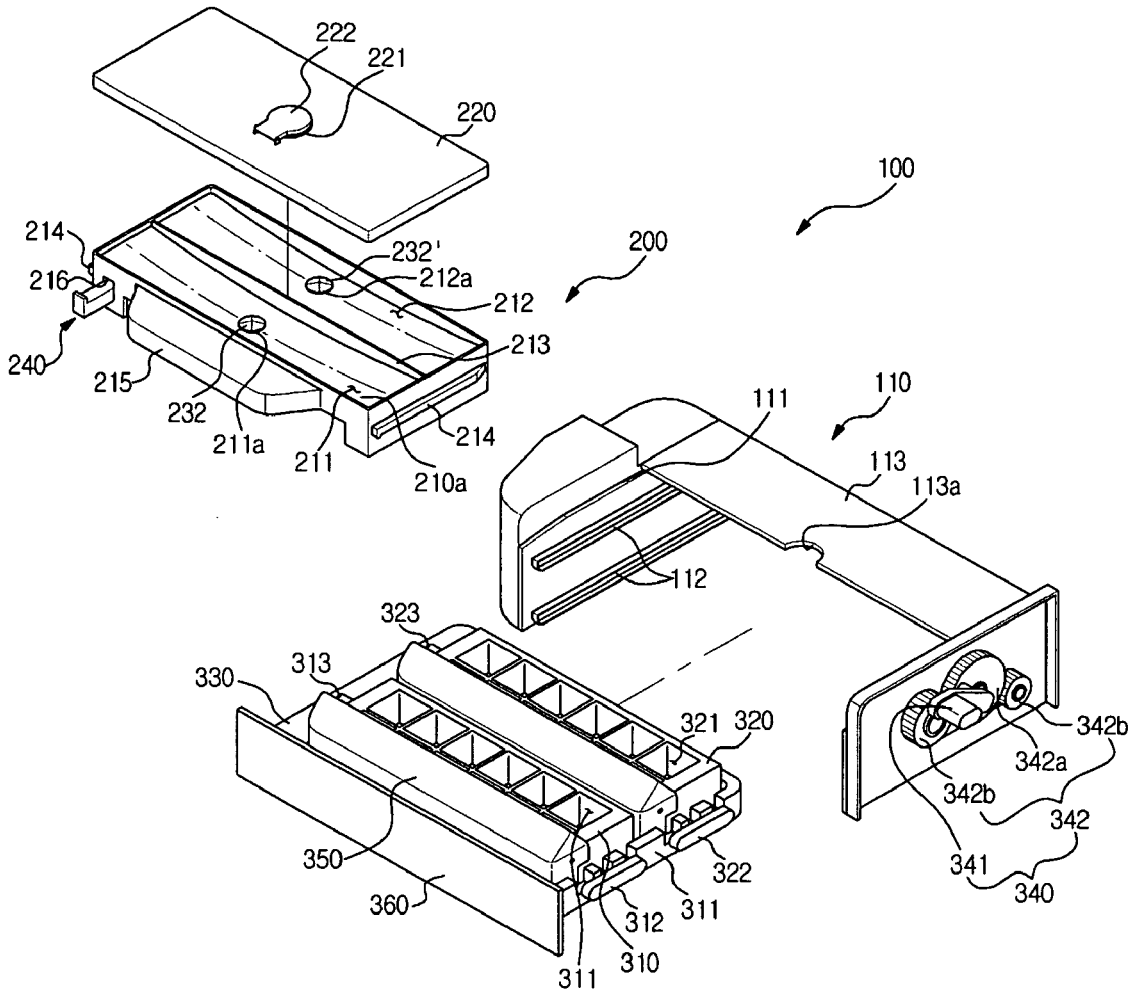
FIG. 3 is a partially exploded perspective view of an ice making apparatus in accordance with the embodiment.
Figure 4:
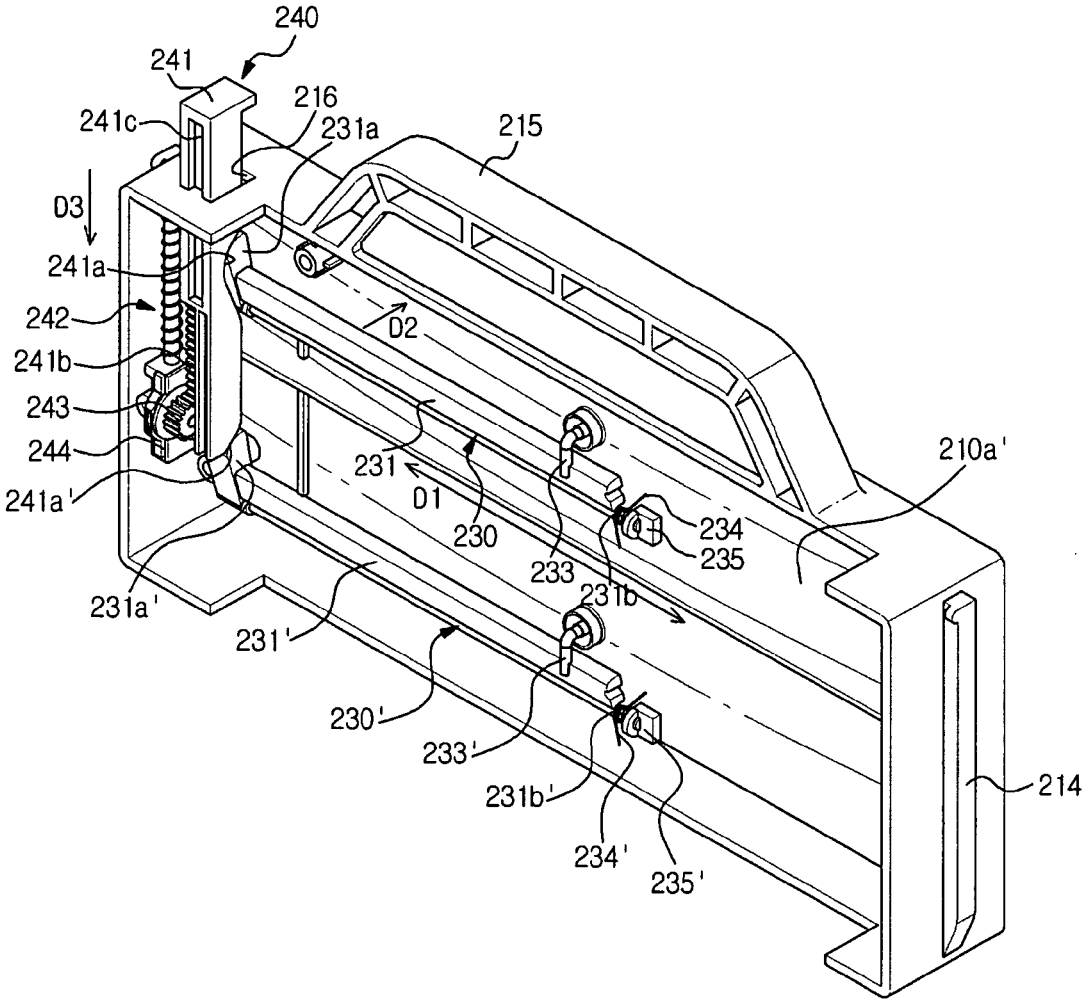
FIG. 4 is a perspective view of a water storage unit in accordance with the embodiment, seen from the bottom surface of a storage main body.
Figure 5:
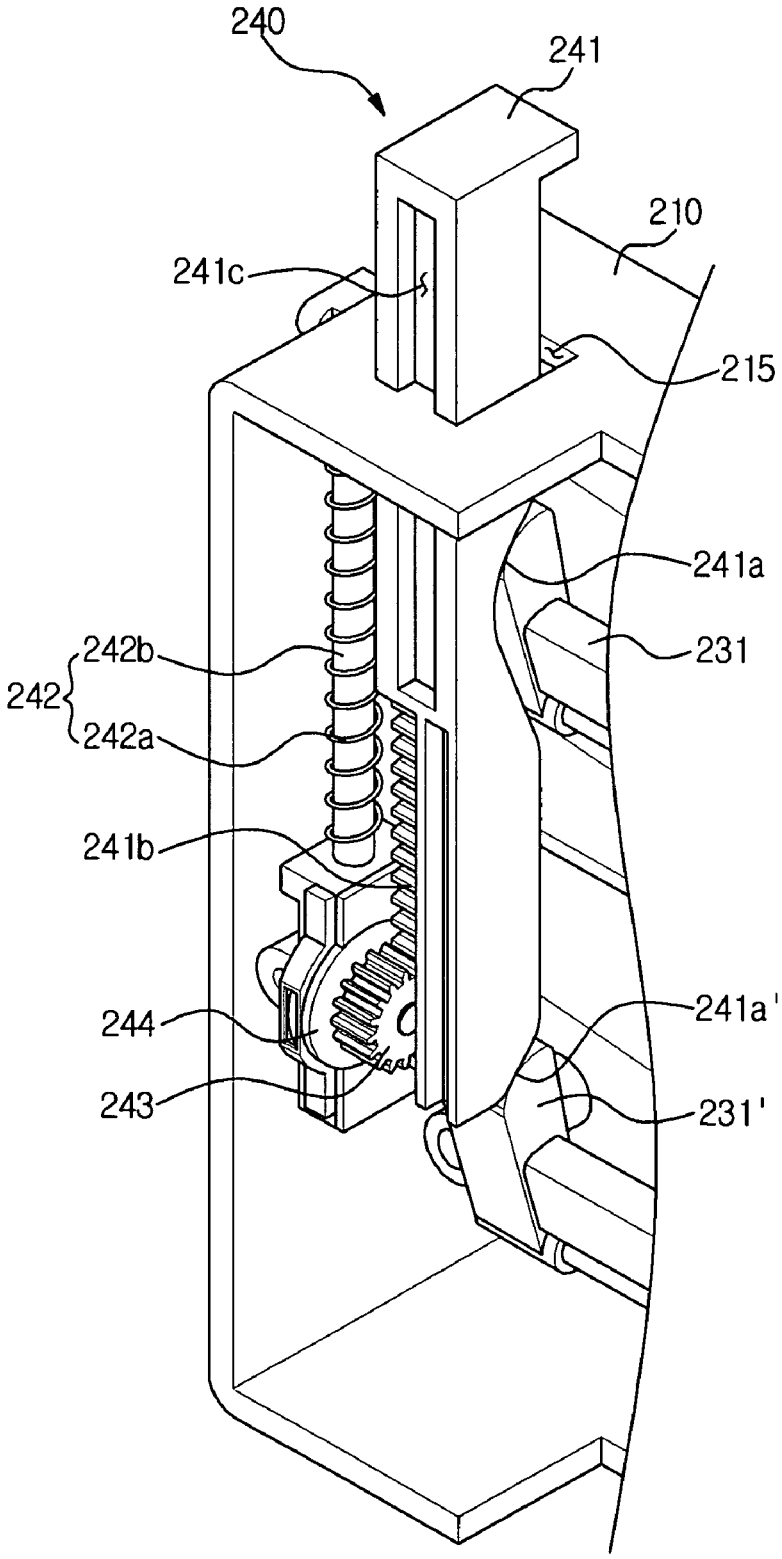
FIG. 5 is an enlarged view of a lever member of FIG. 4.

FIG. 2 is a perspective view of a refrigerator in accordance with this embodiment, FIG. 3 is a partially exploded perspective view of the ice making apparatus in accordance with this embodiment, FIG. 4 is a perspective view of a water storage unit in accordance with this embodiment, seen from the bottom surface of a storage main body, and FIG. 5 is an enlarged view of a lever member of FIG. 4.

As shown in FIGS. 2 to 5, the ice making apparatus 100 in accordance with this embodiment includes a water storage unit 200, an ice making unit 300, an ice storage container 400, and an ice transfer unit 500, which are installed on an ice making housing 100.

The ice making apparatus 100 is provided on a rear surface 41 of the freezing chamber door 40. Here, the ice making apparatus 100 may be provided at the left side of a diaphragm 42 to divide the freezing chamber door 40 into right and left spaces.

The ice making housing 110 supports the water storage unit 200, the ice making unit 300, the ice storage container 400, and the ice transfer unit 500. Although the ice making housing 110 in accordance with this embodiment is manufactured separately from the rear surface 41 of the freezing chamber door 40 and is connected to the rear surface 41 of the freezing chamber door 40, the ice making housing 110 may be manufactured integrally with the rear surface 41 of the freezing chamber door 40.

The water storage unit 200 to store water to make ice cubes is detachably installed at the upper portion of the ice making housing 110. The water storage unit 200 includes a storage main body 210, a storage cover 220, valve members 230 and 230', and an opening and shutting member 240.

The storage main body 210 forms the external appearance of the water storage unit 200, and the upper surface of the storage main body 210 is opened. A water storage space 211 and 212 to store water is provided in the storage main body 210. A division rib 213 extended in a right and left direction is provided at the center of the water storage space 211 and 212. The water storage space 211 and 212 is divided into a first water storage space 211 and a second water storage space 212 by the division rib 213. The first and second water storage spaces 211 and 212 respectively store amounts of water used to make ice cubes once in first and second ice making trays 310 320, which will be described later.

A first water supply hole 211*a* and a second water supply hole 212*a* are formed through the storage main body 210. Water respectively stored in the first and second water storage spaces 211 and 212 is supplied to the first and second ice making trays 310 and 320 through the first and second water supply holes 211*a* and 212*a*. That is, the first and second water supply holes 211*a* and 212*a* are vertically formed through a bottom 210*a* of the storage main body 210 so as to be communicated with the first and second water storage containers 211 and 212. Here, the first and second water supply holes 211*a* and 211*b* may be formed at positions symmetrical with each other with respect to the division rib 213.

Slide parts 214 are respectively provided on the external side surfaces of the storage main body 210. The slide parts 214 are connected to first guide rails 111 of the ice making housing 110, thus allowing the water storage unit 200 to be detachably attached to the ice making housing 110. Further, a grip 215 may be formed on the external front surface of the storage main body 210 so as to allow a user to effectively attach and detach the water storage unit 200 to and from the ice making housing 110.

A storage cover 220 to open and close the first and second water storage spaces 211 and 122 is provided above the storage main body 210. The storage cover 220 has a rectangular shape with a size corresponding to the size of the storage main body 210, and is separably provided above the storage main body 210.

A water supply part 221 is provided on one surface of the storage cover 220. The water supply part 221 may be formed by partially cutting the storage cover 220, and water supplied through the water supply part 221 is stored in the first and second water storage spaces 211 and 212.

A water supply cover part 222 to open and close the water supply part 221 is provided on the storage cover 220. The water supply cover part 222 may be installed such that one end of the water supply cover part 222 is vertically rotatable on the other end of the water supply cover part 222.

The first and second valve members 230 and 230' to open and close the first and second water supply holes 211*a* and 212*a* are installed on the rear surface 210*a'* of the bottom 210*a* of the storage main body 210. The first and second valve members 230 and 230' may be installed in parallel in a first direction D1. The first and second valve members 230 and 230' respectively include first and second interlocking parts 231 and 231', first and second valve caps 232 and 232', and first and second connection parts 233 and 233'.

As shown in FIG. 4, the first and second interlocking parts 231 and 231' move in a second direction D2 in connection with movement of an opening and closing member 240 in a third direction D3. That is, when the first and second interlocking parts 231 and 231' move in the second direction D2, an opened state of the first and second valve caps 232 and 232' is maintained, and when the first and second interlocking parts 231 and 231' move in the opposite direction to the second direction D2, a closed state of the first and second valve caps 232 and 232' is maintained. For this reason, ends 231*a* and 231*a'* of the first and second interlocking parts 231 and 231' respectively contact first and second contact pressure parts 241*a* and 241*a'* of an opening and a closing lever 241, and the other ends 231*b* and 231*b'* of the first and second interlocking parts 231 and 231' are fixed to the rear surface 210*a'* of the bottom 210*a* of the storage main body 210 through first and second fixing members 235 and 235'. Therefore, the first and second interlocking parts 231 and 231' may move centering on the ends 231*b* and 231*b'* thereof in the second direction D2 or in the opposite direction to the second direction D2 according the operating state of the first and second interlocking parts 231 and 231'.

First and second spring members 234 and 234' to apply elastic restoring force to the first and second interlocking parts 231 and 231' may be installed between the ends 231*b* and 231*b'* of the first and second interlocking parts 231 and 231' and the first and second fixing members 235 and 235'. That is, the first and second spring members 234 and 234' move the first and second interlocking parts 231 and 231' in the opposite direction to the second direction D2 to change the opened state of the first and second valve caps 232 and 232' to the closed state of the first and second valve caps 232 and 232'. These first and second spring members 234 and 234' may be torsion springs using restoring force caused by distortion of the first and second interlocking parts 231 and 231'.

Here, the ends 231*a* and 231*a'* of the first and second interlocking parts 231 and 231' may be contact protrusions moving in the second direction D2 along guide planes of the first and second contact pressure parts 241*a* and 241*a'*, and the ends 231*b* and 231*b'* of the first and second interlocking parts 231 and 231' may include connection rods extended from the contact protrusions and fixed to the rear surface 210*a* of the bottom 210*a* of the storage main body 210 through the first and second fixing members 235 and 235'. Further, the first and second interlocking parts 231 and 231' may have an approximately L-shaped rod structure, in which a contact protrusion and a connection rod are integrally formed.

The first and second valve caps 232 and 232' are respectively located at the insides of the first and second water storage spaces 211 and 212. The first and second valve caps 232 and 232*a'* have a sufficient shape and size at least to shield the first and second water supply holes 211*a* and 212*a*, and thus open and close the first and second water supply holes 211*a* and 212*a* (with reference to FIG. 3).

The first and second valve caps 232 and 232' are connected to the first and second interlocking parts 231 and 231' through the first and second connection parts 233 and 233'. The first and second connection parts 233 and 233', which are approximately L-shaped, and pass through the first and second water supply holes 211*a* and 212*a*, and ends of the first and second connection parts 233 and 233' are respectively located within the first and second water storage spaces 211 and 212. The first and second valve caps 232 and 232' are respectively connected to the ends of the first and second connection parts 233 and 233'.

The first and second connection parts 233 and 233' are configured such that the first and second valve caps 232 and 232' open and close the first and second water supply holes 211*a* and 212*a* according to the movement of the first and second interlocking parts 231 and 231' in the second direction D2. Therefore, the first and second connection parts 233 and 233' may have various shapes according to positions of the first and second water supply holes 211*a* and 212*a* and lengths and sizes of the first and second interlocking parts 231 and 231'.

The opening and closing member 240 to move the first and second valve members 230 and 230' to open and close the first and second water supply holes 211*a* and 212*a* is installed at one side of the storage main body 210. The opening and closing member 240 is installed in the third direction D3 of the storage main body 210, and thus contacts ends of the first and second valve members 230 and 230' installed in the first direction D1 of the storage main body 210.

The opening and closing member 240 in accordance with this embodiment of the present invention may be a pushing member 240, which moves first and second valve members 230 and 230', installed in the first direction D1, in the second direction D2, and thus opens and closes the first and second water supply holes 211*a* and 212*a*, when the pushing member 240 moves in the third direction D3. The pushing member 240 may include the opening and closing lever 241, an elastic restoring unit 242, and an oil damper 243.

The opening and closing lever 241 may be a pushing lever 241 having a rod shape made of plastic. The pushing lever 241 is installed in the third direction D3 of the storage main body 210. Here, the pushing lever 241 may be exposed to the outside through an insertion hole 216 of the storage main body 210, and may move in the third direction D3.

The pushing lever 241 includes the first and second contact pressure parts 241*a* and 241*a'* to cause the first and second interlocking parts 231 and 231' to move in the second direction D2 by applying pressure to the pushing lever 241 in the third direction D3 by a user. Therefore, the first and second contact pressure parts 241*a* and 241*a'* respectively contact the first and second interlocking parts 231 and 231'. By this contact, the first and second interlocking parts 231 and 231' may move in the second direction D2 in connection with the movement of the first and second contact pressure parts 241*a* and 241*a'* in the third direction D3.

The first and second contact pressure parts 241*a* and 241*a'* are configured such that they respectively have guide planes bent in designated length and depth. The guide planes of the first and second contact pressure parts 241*a* and 241*a'* contact the ends 231*a* and 231*a'* of the first and second interlocking parts 231 and 231', and thus the pushing lever 241 may be stably supported within the storage main body 210 and the first and second valve caps 232 and 232' may open and close the first and second water supply holes 211*a* and 212*a*, simultaneously.

The pushing lever 241 is provided with a gear part 241*b* having a rack gear shape connected to the oil damper 243. The gear part 241*b* may be formed integrally with the pushing lever 241. The gear part 241*b* is connected to the oil damper 243 and thus prevents the pushing lever 241 from rapidly moving through the elastic restoring unit 242 when the pressure applied to the pushing lever 241 in the third direction D3 is released. Further, the oil damper 243 may be fixed to any one surface of the storage main body 210 through an oil damper-mounted part 244.

The pushing lever 241 is provided with a guide groove 241*c* so as to smoothly move along the insertion hole 216 of the storage main body 210. The guide groove 241*c* is connected to a guide protrusion formed on the storage main body 210 toward the insertion hole 216, and thus guides the pushing lever 241 to smoothly move in the third direction D3.

The elastic restoring unit 242, to cause the pushing lever 241 to move in the opposite direction to the third direction D3 when the pressure applied to the pushing lever 241 in the third direction D3 is released, is installed at one side of the pushing lever 241. Further, the elastic restoring unit 242 applies force to the pushing lever 241 in the opposite direction to the third direction D3, in which the first and second valve caps 232 and 232' close the first and second water supply holes 211*a* and 212*a* through the first and second contact pressure parts 241*a* and 241*a'*.

The elastic restoring unit 242 includes a spring part 242*a*, such as a compression spring, and a spring-mounted part 242*b* to guide movement of the spring part 242*a* and support the spring part 242*a*. The spring-mounted part 242*b* is fixedly installed between any one surface of the storage main body 210 and the oil damper 243 at one side of the pushing lever 242, and the spring part 242*a* surrounds the outer surface of the spring-mounted part 242*b* between the gear part 241*b* of the pushing lever 241 and the oil damper 243. Therefore, when pressure applied to the pushing lever 241 in the third direction D3 is released, the pushing lever 241 moves in the opposite direction to the third direction D3 by the elastic force of the spring part 242*a* and thus is restored to its original position before the pressure is applied to the pushing lever 241 in the third direction D3 (with reference to FIGS. 6 and 7).

As shown in FIG. 2 the ice making unit 300 is detachably installed below the water storage unit 200. The ice making unit 300 receives water supplied from the water storage unit 200, makes ice cubes, and transfers the ice cubes to the ice storage container 400. The ice making unit 300 includes the first and second ice making trays 310 and 320, a support frame 330, a rotary assembly 340, and anti-overflow members 350.

The support frame 330 has a rectangular shape. The support frame 330 rotatably supports the first and second ice making trays 310 and 320 and is detachably mounted on the ice making housing 110, simultaneously.

A slide plane 331 is provided on each of both sides of the support frame 330. The slide planes 331 of the support frame 330 serve to guide the ice making unit 300 such that the ice making unit 300 is mounted on the ice making housing 110 under the condition the ice making unit 300 is inserted between second guide rails 112 of the ice making housing 110.

As shown in FIG. 3, the first and second ice making trays 310 and 320 make ice cubes using water supplied from the first and second water storage spaces 211 and 212 of the water storage unit 200. The first and second ice making trays 310 and 320 make ice cubes using water supplied from the first and second water storage spaces 211 and 212, respectively. The first and second ice making trays 310 and 320 include multiple ice making holes 311 and 321, respectively.

The first and second ice making trays 310 and 320 further include rotation connection parts 312 and 322 and rotary shafts 313 and 323, respectively. The rotation connection parts 312 and 322 and the rotary shafts 313 and 323 are rotational centers of the first and second ice making trays 310 and 320. The rotation connection parts 312 and 322 are coupled to the rotary assembly 340 when the ice making unit 300 is completely inserted into the ice making housing 110, and thus are capable of being supported by the ice making housing 110. The rotary shafts 313 and 323 are rotatably supported by the support frame 330.

The ice making unit 110 includes the rotary assembly 340 to rotate and twist the first and second ice making trays 310 and 320. The rotary assembly 340 is fixed to the ice making housing 110, and includes a manipulation lever 341 and a plurality of gears 342.

The manipulation lever 341 is configured such that a user grips and rotates the manipulation lever 341 by hand so as to rotate and twist the first and second ice making trays 310 and 320.

The gears 342 include one driving gear 342*a* and a pair of driven gears 342*b*. The driving gear 342*a* is connected to the manipulation lever 341, and thus is rotated in the same direction as the rotation of the manipulation lever 341 by the rotation of the manipulation lever 341. The driven gears 342*b* are respectively connected to the rotation connection parts 312 and 322, and are engaged with the driving gear 342*a*. Therefore, when the manipulation lever 341 is rotated, the driving gear 342*a* is rotated, and the driven gears 342*b* are rotated in the same direction by the rotation of the driving gear 342*a*.

Further, the anti-overflow member 350 to prevent overflow of water supplied to each of the first and second ice making trays 310 and 320 is installed at each of the first and second ice making trays 310 and 320.

As shown in FIG. 2, the ice storage container 400 is detachably mounted below the ice making unit 300. The ice storage container 400 has a hexahedral shape with a low depth, the upper surface of which is opened. An ice storage space 410 to store the ice cubes made by the first and second ice making trays 310 and 320 is provided within the ice storage container 400.

The ice transfer unit 500 transfers the ice cubes stored in the ice storage container 400 to an ice discharge hole (not shown) formed through the ice storage container 400. The ice transfer unit 500 includes an ice transfer member 510 rotatably provided within the ice storage container 400, and a driving motor (not shown) provided on the rear surface 41 of the freezing chamber door 40 to generate driving force transmitted to the ice transfer member 510.

Non-described reference numeral 113 is a base member formed on the ice making housing 110, non-described reference numeral 113*a* is a cover hole formed on the base member 113 so as to be connected to the water supply cover part 222, and non-described reference numeral 360 is a cover forming the front surface of the ice making unit 300.

Hereinafter, with reference to FIGS. 6 and 7, relations between the pushing member and the valve members in accordance with this embodiment will be described.

Figure 6:
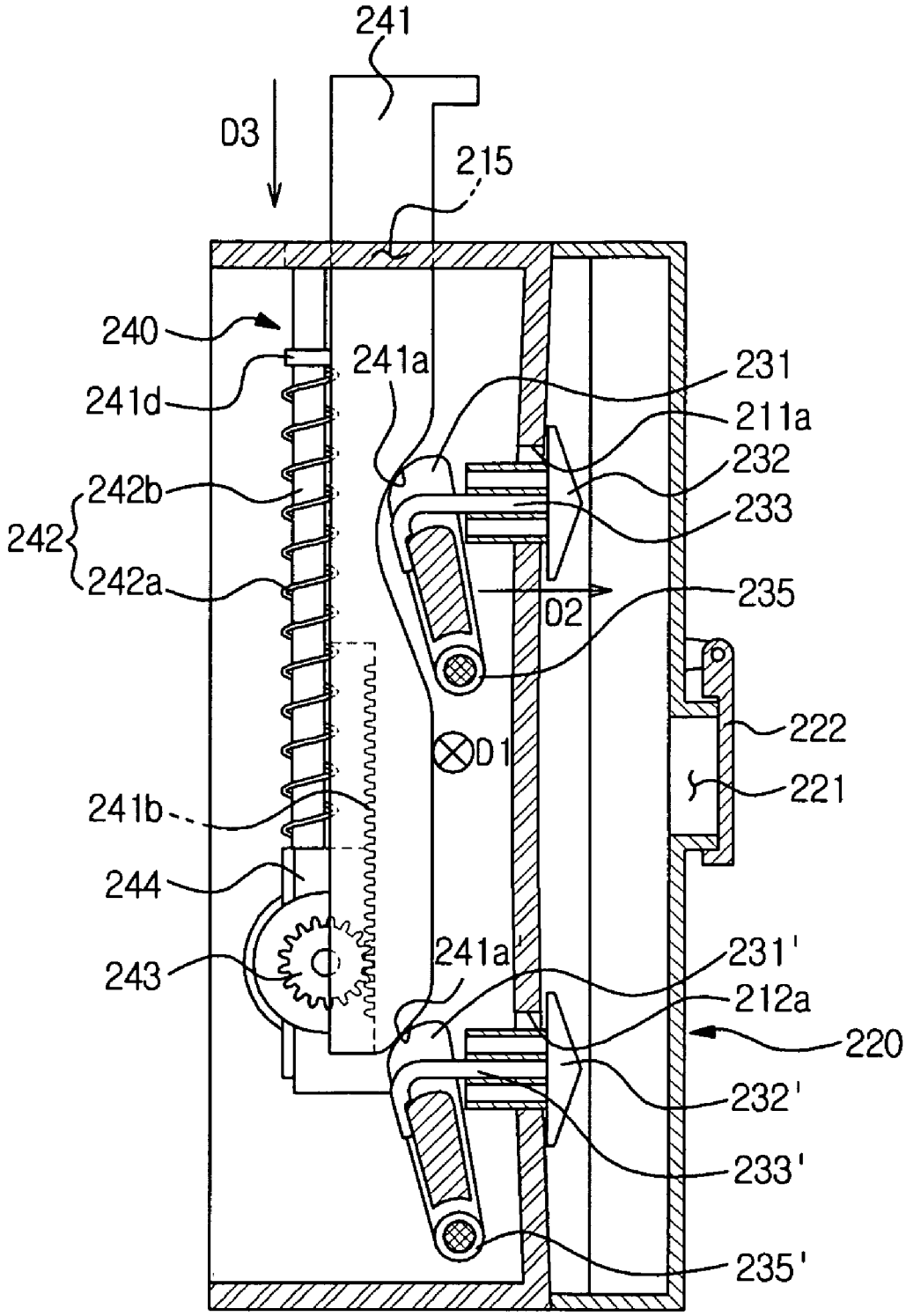
FIG. 6 is a view illustrating a state in which valve members of FIG. 4 close water supply holes.
Figure 7:
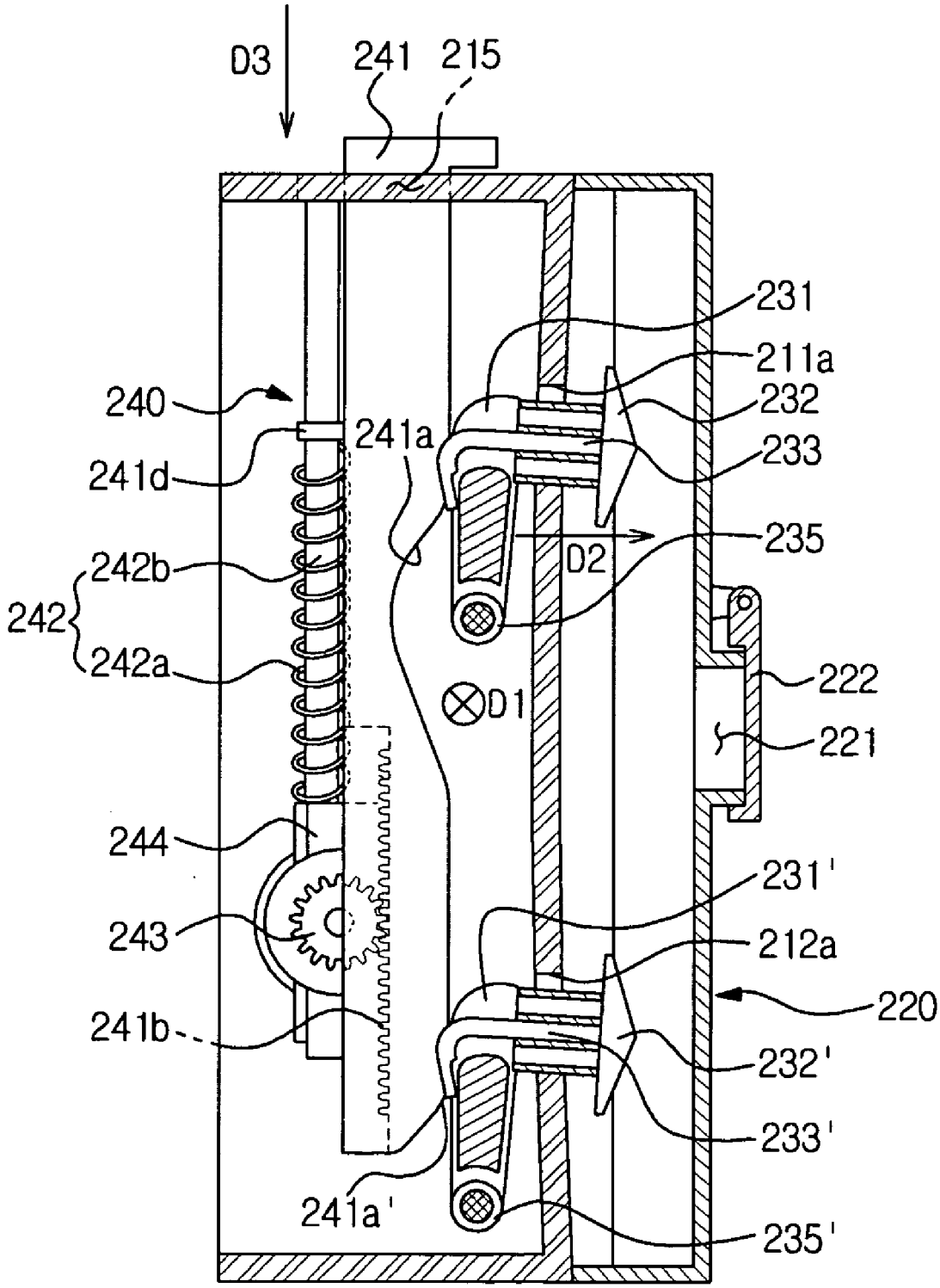
FIG. 7 is a view illustrating a state in which the valve members of FIG. 4 open the water supply holes.

FIG. 6 is a view illustrating a state in which the valve members of FIG. 4 close the water supply holes, and FIG. 7 is a view illustrating a state in which the valve members of FIG. 4 open the water supply holes.

With reference to FIGS. 6 and 7, when pressure is applied to the pushing lever 241 in the third direction D3, the first and second contact pressure parts 241*a* and 241*a*' and the spring part 242*a* move in the third direction D3. Here, ends of the first and second interlocking parts 231 and 231' move in the second direction D2 along the first and second contact pressure parts 241*a* and 241*a*'. Further, the first and second valve caps 232 and 232' move in the second direction D2 according to the motion of the first and second interlocking parts 231 and 231', and thus open the first and second water supply holes 211*a* and 212*a*.

On the other hand, when the pressure applied to the pushing lever 241 is released, the first and second interlocking parts 231 and 231' move in the opposite direction to the second direction D2 by the elastic restoring force of the first and second spring members 234 and 234'. Simultaneously, the first and second valve caps 232 and 232' move in the opposite direction to the second direction D2, and thus close the first and second water supply holes 211*a* and 212*a*. Further, the pushing lever 241 moves in the opposite direction to the third direction D3 by the spring part 242*a* of the elastic restoring unit 242. At this time, the oil damper 243 is engaged with the gear part 241*b* of the pushing lever 241, and thus prevents the pushing member 240 from momentarily moving in the opposite direction to the third direction D3.

Accordingly, since the first and second valve members open and close the first and second water supply holes by the pushing lever after the water storage unit is mounted in the freezing chamber, water stored in the water storage unit does not overflow into the inside of the freezing chamber, and thus the ice making apparatus and the refrigerator having the same may be kept more clean.

Hereinafter, an ice making apparatus in accordance with another embodiment will be described with reference to FIGS. 8 to 10. Some parts in this embodiment, which are substantially the same as those in the former embodiment, are denoted by the same reference numerals even though they are depicted in different drawings, and a detailed description thereof will thus be omitted because it is considered to be unnecessary.

Figure 8:
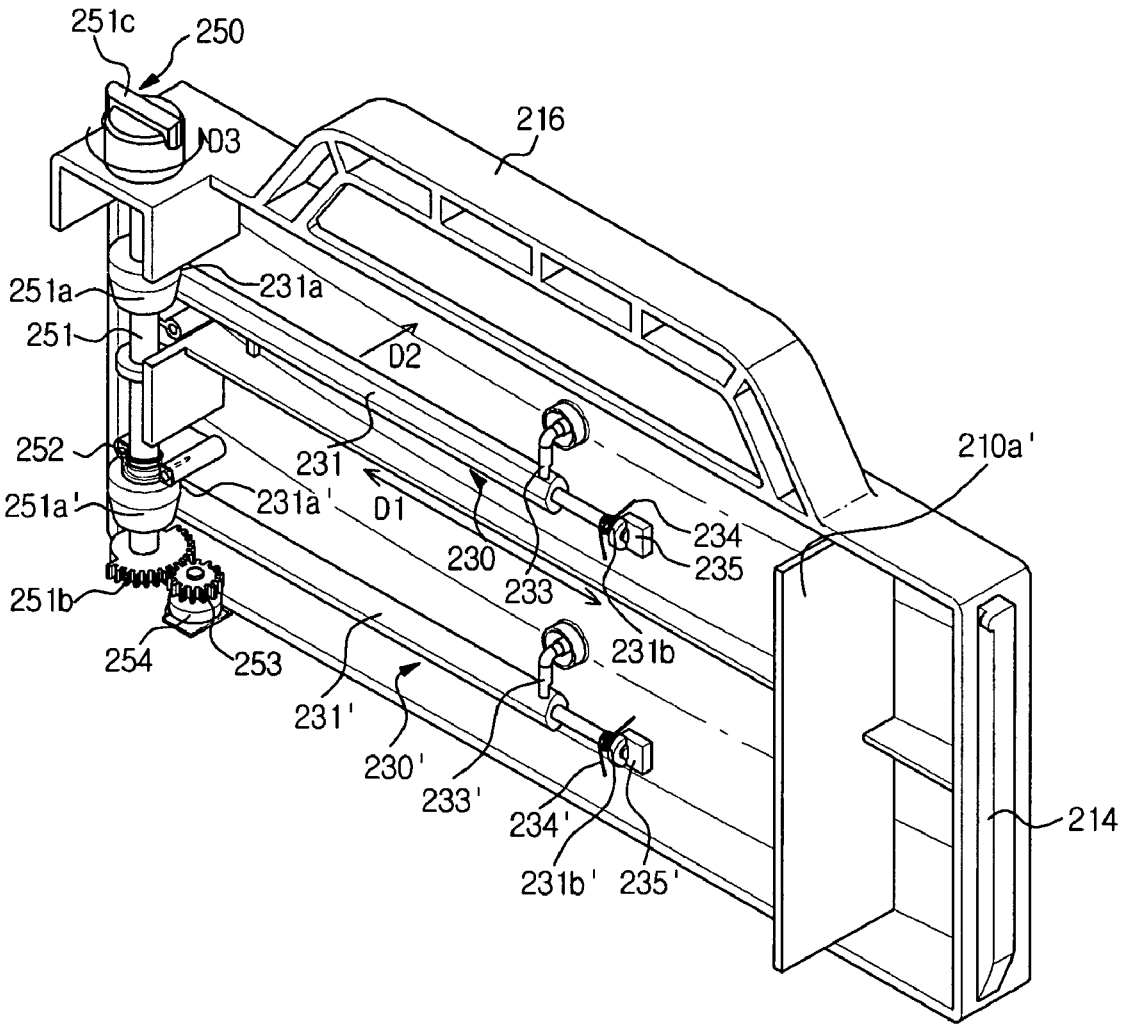
FIG. 8 is a perspective view of a water storage unit in accordance with another embodiment, seen from the bottom surface of a storage main body.
Figure 9:
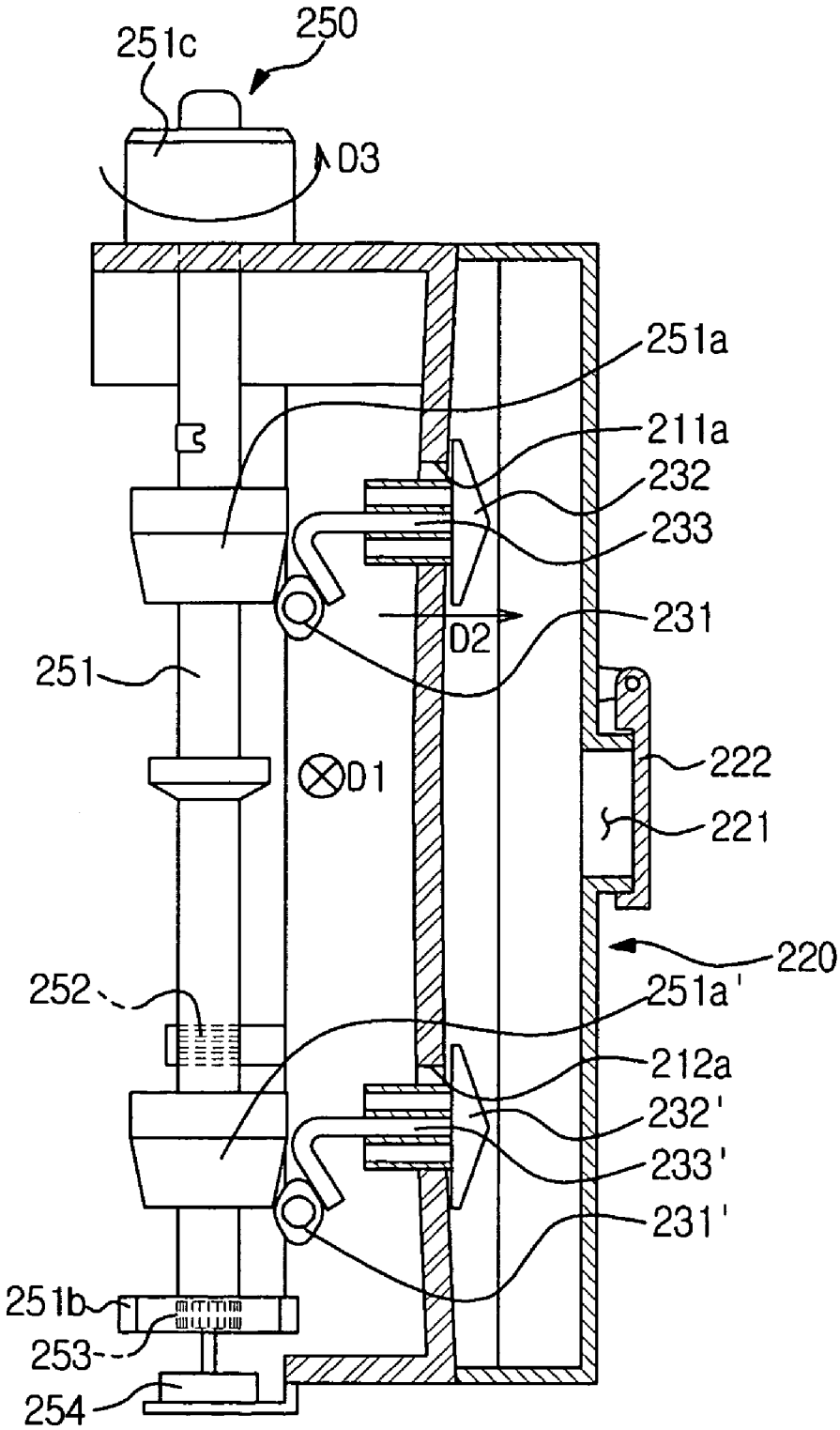
FIG. 9 is a view illustrating a state in which valve members of FIG. 8 close water supply holes.
Figure 10:
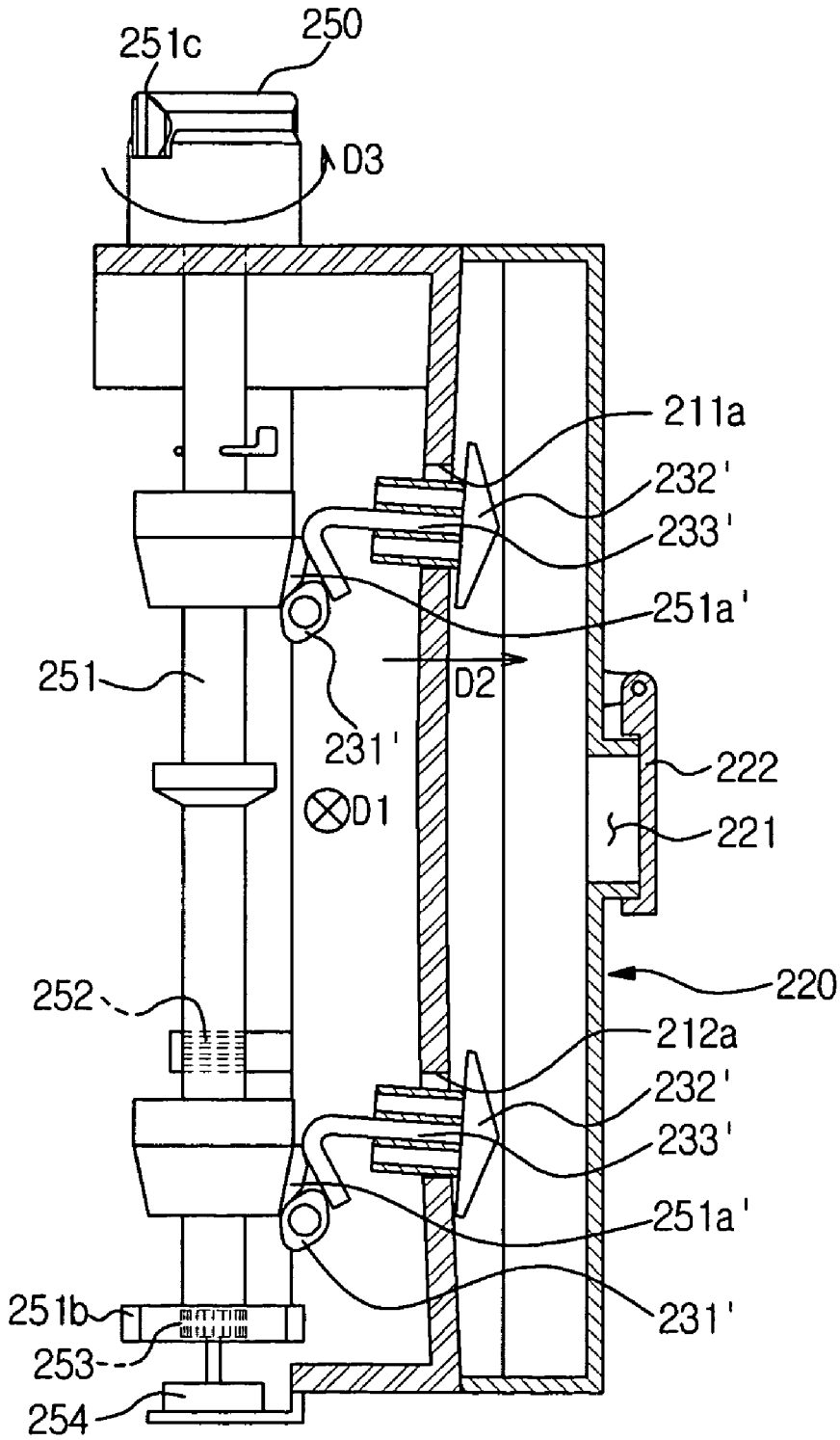
FIG. 10 is a view illustrating a state in which the valve members of FIG. 8 open the water supply holes.

FIG. 8 is a perspective view of a water storage unit in accordance with this embodiment, seen from the bottom surface of a storage main body, FIG. 9 is a view illustrating a state in which valve members of FIG. 8 close water supply holes, and FIG. 10 is a view illustrating a state in which the valve members of FIG. 8 open the water supply holes.

As shown in FIGS. 8 to 10, an opening and closing member 250 in accordance with this embodiment may be a rotating member 250, which moves first and second valve members 230 and 230', installed in the first direction D1, in the second direction D2, and thus opens and closes first and second water supply holes 211*a* and 212*a*, when the rotating member 250 is rotated in the third direction D3. The rotating member 250 may include an opening and closing lever 251, an elastic restoring unit 252, and an oil damper 253.

The opening and closing lever 251 may be a rotating lever 251 having a rod shape made of plastic. The rotating lever 251 may be exposed to the outside through an insertion hole 216 of the storage main body 210, and may be rotated in the third direction D3.

The rotating lever 251 includes first and second contact pressure parts 251*a* and 251*a*' to cause the first and second interlocking parts 231 and 231' to move in the second direction D2 by rotation of the rotating lever 251 in the third direction D3 by a user. The first and second contact pressure parts 251*a* and 251*a*' respectively contact the first and second interlocking parts 231 and 231'. By this contact, the first and second interlocking parts 231 and 231' move in the second direction D2 in connection with the movement of the first and second contact pressure parts 251*a* and 251*a*' in the third direction D3.

The first and second contact pressure parts 251*a* and 251*a*' are configured such that they respectively have guide planes bent in designated length and depth. The guide planes of the first and second contact pressure parts 251*a* and 251*a*' contact ends 231*a* and 231*a*' of the first and second interlocking parts 231 and 231', and thus the rotating lever 251 may be stably supported within the storage main body 210 and the first and second valve caps 232 and 232' may open and close the first and second water supply holes 211*a* and 212*a*, simultaneously.

The rotating lever 251 is provided with a gear part 251*b* having a spur gear shape connected to the oil damper 253. The gear part 251*b* may be formed integrally with the rotating lever 251. The gear part 251*b* is connected to the oil damper 253 and thus prevents the rotating lever 251 from rapidly moving through the elastic restoring unit 252 when the pressure applied to the rotating lever 251 in the third direction D3 is released. Further, the oil damper 253 may be fixed to any one surface of the storage main body 210 through an oil damper-mounted part 254.

The elastic restoring unit 252, to cause the rotating lever 251 to rotate in the opposite direction to the third direction D3 when the pressure applied to the rotating lever 251 in the third direction D3 is released, is installed at one side of the rotating lever 251. Further, the elastic restoring unit 252 applies force to the rotating lever 251 in the opposite direction to the third direction D3, in which the first and second valve caps 232 and 232' close the first and second water supply holes 211*a* and 212*a* through the first and second contact pressure parts 241*a*and 241*a*'. The elastic restoring unit 2522 includes a spring part (not shown), such as a torsion spring, and a spring-mounted part to support the spring part.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An ice making apparatus comprising:

a water storage unit having a storage main body, in the water storage unit water is stored;

an ice making unit to make ice cubes through supply of water stored in the storage main body;

at least one valve member to open and close a water supply hole, through the water supply hole water stored in the storage main body is supplied to the ice making unit; and an opening and closing member to move the at least one valve member so as to open the water supply hole, wherein the opening and closing member includes a pushing member having an opening and closing lever, the opening closing lever moves the at least one valve member when pressure is applied to the opening and closing lever, gear part having a gear shape integrally formed with the opening and closing lever, and an oil damper connected to the gear part.

2. The ice making apparatus according to claim 1, wherein the at least one valve member includes an interlocking part having a rod shape moving in connection with movement of the opening and closing lever, and a valve cap moving along the interlocking part to open and close the water supply hole.

3. The ice making apparatus according to claim 1, wherein the opening and closing member further includes an elastic restoring unit having a spring part to apply restoring force to the opening and closing lever.

4. The ice making apparatus according to claim 2, wherein:

the opening and closing member further includes a contact pressure part contacting the interlocking part; and the interlocking part moves along the contact pressure part when the opening and closing lever moves.

5. The ice making apparatus according to claim 2, wherein the interlocking part is formed in an approximately L-shaped rod shape, and one end of the interlocking part contacts the opening and closing lever and the other end of the interlocking part is fixed to a rear surface of a bottom of the water storage unit.

6. The ice making apparatus according to claim 2, wherein:

the interlocking part includes a contact protrusion moving along a guide plane of the contact pressure part, and a connection rod extended from the contact protrusion; and the connection rod is fixed to a rear surface of a bottom of the water storage unit through a fixing member.

7. The ice making apparatus according to claim 2, wherein the at least one valve member further includes a connection part to connect the interlocking part to the valve cap, and a spring part to apply elastic restoring force to the interlocking part and the valve cap.

8. The ice making apparatus according to claim 1, wherein:

the water supply hole includes a first water supply hole and a second water supply hole;

the at least one valve member includes a first valve member to open and close the first water supply hole and a second valve member to open and close the second water supply hole; and the opening and closing member moves the first and second valve members.

9. The ice making apparatus according to claim 1, wherein the opening and closing lever includes a guide groove.

10. The ice making apparatus according to claim 1, wherein the water storage unit includes a grip.

11. The ice making apparatus according to claim 1, wherein the opening and closing lever is made of plastic.

12. The ice making apparatus according to claim 1, wherein the ice making unit includes ice making trays, and anti-overflow members to prevent overflow of water supplied to the ice making trays.

13. The ice making apparatus according to claim 1, wherein:

the at least one valve member is installed lengthily in a first direction, and the opening and closing member moves in a third direction in order to move the at least one valve member in a second direction; and at least one of the first, second, and third directions is perpendicular to another of the first, second, and third directions.

14. The ice making apparatus according to claim 1, wherein an ice storage container, and an ice transfer unit to transfer ice cubes stored in the ice storage container to an ice discharge hole formed through the ice storage container are provided below the ice making unit.

15. An ice making apparatus comprising:

a water storage unit having a storage main body, in which water is stored;

an ice making unit to make ice cubes through supply of water stored in the storage main body;

at least one valve member to open and close a water supply hole, through the supply hole water stored in the storage main body is supplied to the ice making unit; and an opening and closing member to move the at least one valve member so as to open the water supply hole, wherein the opening and closing member includes a rotating member having an opening and closing lever, the opening closing lever moves the at least one valve member when the opening and closing lever is rotated, a gear part having a gear shape integrally formed with the opening and closing lever, and an oil damper connected to the gear part.

16. The ice making apparatus according to claim 15, wherein the at least one valve member includes an interlocking part having a rod shape moving in connection with movement of the opening and closing lever, and a valve cap moving along the interlocking part to open and close the water supply hole.

17. The ice making apparatus according to claim 15, wherein the opening and closing member further includes an elastic restoring unit having a spring part to apply restoring force to the opening and closing lever.

18. The ice making apparatus according to claim 15, wherein the opening and closing lever is made of plastic.

19. A refrigerator comprising a main body provided with storage chambers, doors to respectively open and close the storage chambers, and an ice making apparatus provided on a rear surface of any one of the doors to make ice cubes, wherein: the ice making apparatus includes an ice making housing provided on the rear surface of the any one of the doors, and a water storage unit detachably installed on the ice making housing; and the water storage unit includes a storage main body having first and second water supply holes, first and second valve members having a rod shape to respectively open and close the first and second water supply holes, and an opening and closing member having an opening and closing lever contacting the first and second valve members to ascend and descend the first and second valve members; and the opening and closing member includes a pushing member having an opening and closing lever, the opening closing lever moves the first and second valve members when pressure is applied to the opening and closing lever, a gear part having a gear shape integrally formed with the opening and closing lever, and an oil damper connected to the gear part.

20. The refrigerator according to claim 19, wherein each of the first and second valve members includes an L-shaped interlocking part moving in connection with movement of the opening and closing lever, and a valve cap to open and close each of the first and second water supply holes along the interlocking part.

21. The refrigerator according to claim 19, wherein the first and second valve members are disposed perpendicularly to one direction such that they ascend and descend in the direction, and the opening and closing member includes a pushing member having an opening and closing lever contacting the first and second valve members and applying pressure to the first and second valve members through a pushing operation.

22. The refrigerator according to claim 19, wherein the first and second valve members are disposed perpendicularly to one direction such that they ascend and descend in the direction, and the opening and closing member includes a rotating member having an opening and closing lever contacting the first and second valve members and applying pressure to the first and second valve members through a rotating operation.

23. An ice making apparatus comprising:

a water storage unit having a storage main body, in which water is stored;

an ice making unit to make ice cubes through supply of water stored in the storage main body;

at least one valve member to open and close a water supply hole, through the water supply hole water stored in the storage main body is supplied to the ice making unit; and an opening and closing member to move the at least one valve member so as to open the water supply hole, wherein the at least one valve member includes an interlocking part having a rod shape moving in connection with movement of the opening and closing member, a valve cap to open and close the water supply hole, and a connection part to connect the interlocking part to the valve cap, and wherein one end of the interlocking part contacts the opening and closing member and the other end of the interlocking part is fixed to a rear surface of a bottom of the water storage unit.

* * * * *

UNITED STATES PATENT AND TRADEMARK OFFICE

CERTIFICATE OF CORRECTION

PATENT NO. : 8,371,139 B2
APPLICATION NO. : 12/659402
DATED : February 12, 2013
INVENTOR(S) : Ji Hoon Kim et al.

It is certified that error appears in the above-identified patent and that said Letters Patent is hereby corrected as shown below:

In the Claims

Column 11, Line 58, In Claim 1, delete "opening closing" and insert -- opening and closing --, therefor.

Column 11, Line 60, In Claim 1, delete "gear" and insert -- a gear --, therefor.

Column 13, Line 7, In Claim 15, delete "opening closing" and insert -- opening and closing --, therefor.

Column 13, Line 40, In Claim 19, delete "opening closing" and insert -- opening and closing --, therefor.

Signed and Sealed this
Fourth Day of June, 2013

Teresa Stanek Rea

Teresa Stanek Rea
*Acting Director of the United States Patent and Trademark Office*